US006398203B1

(12) United States Patent
Saito et al.

(10) Patent No.: US 6,398,203 B1
(45) Date of Patent: Jun. 4, 2002

(54) SHEET POST-HANDLING DEVICE

(75) Inventors: Takashi Saito, Kofu; Keiichi Nagasawa; Shigeyuki Sanmiya, both of Yamanashi-ken, all of (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 09/590,929

(22) Filed: Jun. 9, 2000

(30) Foreign Application Priority Data

Jun. 11, 1999 (JP) ..... 11-165948
Apr. 21, 2000 (JP) ..... 2000-120501

(51) Int. Cl.[7] ..... B41J 19/00; B65H 33/04
(52) U.S. Cl. ..... 270/58.12; 227/150; 227/154
(58) Field of Search ..... 400/625; 227/2–7, 227/99–106, 140, 150, 154; 270/58.12, 58.13, 58.23, 58.27, 58.28, 58.14

(56) References Cited

U.S. PATENT DOCUMENTS 5,542,655 A 8/1996 Murakami ..... 270/58.14
5,634,632 A 6/1997 Furuya et al. ..... 270/58.12
5,649,695 A 7/1997 Lawrence ..... 270/58.12
6,006,065 A 12/1999 Seki ..... 270/58.23
6,012,385 A 8/2000 Wakamatso et al. ..... 270/58.12
6,171,225 B1 1/2001 Nonoyama et al. ..... 270/58.12

*Primary Examiner*—Eugene Eickholt
(74) *Attorney, Agent, or Firm*—Pitney, Hardin, Kipp & Szuch LLP

(57) ABSTRACT

A sheet post-handling device made compact by incorporating a stapling unit within a first side frame and a sheet transferring system in a second side frame. A simple mechanism formed of only one driving motor and a transmission means with sheet transmission rollers and a timing gear wheel operated with exquisite timing enables the sheet transferring system to be rationally assembled within the second side frame. With the sheet transferring system, a sheet fed from an image forming apparatus such as a copying machine is transferred in the forward direction, and then, sent back onto a processing tray in the reverse direction. A plurality of sheets sent onto and stacked on the processing tray are stapled, and thereafter, sent out in the forward direction. The stapling unit is movably mounted on the first side frame to facilitate fitting and removal of the staple cartridge into and from the stapling unit and maintenance of the device.

10 Claims, 12 Drawing Sheets

1
a3
g3
w1
w2
30a
32
30
31
30c
33a
33b
61e
32a
61
6b
6a
g6
w4
w3
30b
30d

SHEET POST-HANDLING DEVICE

BACKGROUND OF THE INVENTION

1 Field of the Invention

This invention relates to a device for performing such post-processing as sorting and stapling of sheets fed out from an image forming apparatus such as a copying machine to which this device is joined, and more particularly to a sheet post-handling device having a stapling system and driving system assembled rationally within side frames of the device, thereby to make the device compact.

2. Description of the Prior Art

There has been generally used a sheet post-handling device provided with a stapling unit in order to automatically performing post-processing such as sorting and stapling of sheets undergoing image processing in an image forming apparatus such as a copying machine and a printer. The sheet post-handling device coupled to a sheet discharge part of the image forming apparatus is provided with mechanisms for placing in order, sorting, aligning and stapling the sheets, and/or arranging the pages of the sheets properly on one or more sheet processing trays.

The sheet processing tray for stacking the whole sheets thereon to process the sheets calls for a large space for accommodating the sheets entirely, resulting in a large overall size of the device. Specifically when handling the sheet of large size, the increase in size and weight of the device entails a disadvantage such that the device inevitably turns out to be awkward to handle. Such a disadvantage may be somewhat surmounted by such a device as disclosed in U.S. Pat. No. 5,385,340, in which only one end part of sheets is supported inside, holding the remaining part outside when being stapled.

However, there is a limit in reducing the size of the sheet handling device, provided an operating mechanism including systems for transferring a sheet to be processed, controlling driving components and transmitting drivng power to the driving components is not made compact. The sheet post-handling device of this type cannot be made compact as long as it employs complicated operating mechanism relying on a plurality of driving motors and intricate power transmission means. Moreover, the conventional sheet post-handling device has a disadvantage of being complicated in control and working motion thereof and susceptible to mechanical troubles and/or failure to transfer the sheet.

Although the sheet post-handling device of this type is desired to be easy to handle in loading a stapling unit with staples for binding the sheets and maintaining the stapling unit, the conventional device is disadvantageous in that the stapling unit immovably fixed on the device must be located at a position renderng the staple-loading work difficult in case where an image forming apparatus to which the sheet post-handling device is coupled is set at a narrow place or inconvenient situation. Under certain circumstances, the heavy device must be moved whenever the stapling unit is loaded with the staples. This turns out to be a very troublesome chore.

OBJECT OF THE INVENTION

An object of the present invention is to provide a sheet post-handling device having a simple sheet post-handling mechanism including a stapling unit and a driving mechanism including a sheet transferring system and a motion transmission system are rationally incorporated within a device frame, thereby making the device compact.

Another object of the present invention is to provide a sheet post-handling device capable of being made compact by using a single driving motor, a simple driving mechanism for transferring sheets and applying driving power and a simple control system, and assuredly and efficiently performing desired sheet post-handling operation by controlling the driving mechanism with exquisite timing.

Still another object of the present invention is to provide a sheet post-handling device capable of being easily operated and handled without requiring spatial restriction by permitting an operator to easily approach and handle a stapling unit incorporated in the device in loading the stapling unit with staples and effecting maintenance of the device.

SUMMARY OF THE INVENTION

To attain the objects described above aocording to this invention, there is provided a sheet post-handling device comprising first and second side frames, a sheet processing tray for supporting sheets to be processed, which is defined by the side frames, a stapling unit for stapling the sheets, which is mounted within the first side frame at one side portion of the sheet processing tray, a sheet transferring system for transferring the sheet from a sheet reception part to a sheet discharge part through the sheet processing tray, and a driving system for driving the sheet transferring system, which is mounted in the second side frame and includes a driving power source and driving elements.

This sheet post-handling device is joined to a sheet discharge portion of an image forming apparatus such as a copying machine, to which a sheet is fed from the image forming apparatus after subjecting the sheet to image processing in the image forming apparatus. In the case of stapling the sheets fed from the image forming apparatus by using the stapling unit in the sheet post-handling device, the sheets traveling from the sheet reception part toward the sheet discharge part is moved backward to the sheet processing tray. When sending a prescribed number of sheets onto the sheet processing tray, the sheets are pressed laterally against the first side frame by a sheet aligning member to align the sheets, and then, stapled by the stapling unit. The stapled sheets are sent out to an external tray through the sheet discharge part.

The sheet transferring system indudes sheet introducing rollers located at the sheet reception part, sheet feeding rollers arranged on a sheet transfer passage extending from the sheet reception part to the sheet discharge part, an elastically deformable feeding ring of a large diameter being inscribed with one of the aforesaid feeding rollers so as to send forward the sheet placed on the sheet transfer passage and move backward the sheet placed on the sheet processing tray, a paddle for causing the sheet traveling forward along the sheet transfer passage to be moved backward to the sheet processing tray, and paired sheet discharge rollers for sending out the sheets stapled on the sheet processing tray to the external tray.

As the sheet is fed from the image forming apparatus, the sheet introducing rollers, feeding rolers and feeding ring are constantly rotated to forward the sheet along the sheet transfer passage.

In the case of stapling the sheets, the sheet traveling along the sheet transfer passage is moved backward onto the sheet processing tray by rotating the paddle in the reverse direction when the tail end of the sheet passes through the feeding rollers. The paddle, which is selectively rotated by the feeding rollers, makes one rotation in the reverse direction to move the sheet backward. As the sheets thus fed onto the sheet processing tray come up to the prescribed number, the stapling unit is operated to staple the sheets on the tray into a bundle. Upon completion of the stapling, the sheets thus stapled are discharged in a bundle to the external tray through the sheet discharge part by rotating the sheet discharge rollers.

The driving system for operating the sheet transferring system indudes a driving motor for rotating the sheet infroducing rollers and feeding ring, and a timing gear wheel which is selectively rotated by the feeding ring. A motion transmission means through which the rotation of the timing gear wheel is transmitted to the sheet discharge rollers may be incorporated within the first side frame.

The timing gear wheel to be meshed with an intermediate gear has a non-toothed part in which no gear tooth is formed, so as to selectively transmit the rotation of the feeding rollers through the intermediate gear. The timing gear wheel is provided with a cam for rocking a rocking arm supporting one of the sheet discharge rollers, which is in separable contact with the other sheet discharge rollers. The paired sheet discharge rollers come in contact with each other in a sheet forwarding mode for sending out the sheet to the discharge part, and are out of contact therewith in a sheet aligning mode for moving the sheet backward.

The driving system for transferring the sheet is operated by a single motor, so that the mechanism for driving and controlling the system can be incorporated rationally within one side frame, and consequently, the device can be made compact.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

This invention relates to a compact sheet post-handling device for subjecting sheets fed from an image forming apparatus such as a copying machine to post-processing such as sheet aligning and stapling operations in the state of partly supporting the sheets inside the device. One embodiment of the invention will be described hereinafter with reference to the accompanying drawings.

Figure 1:
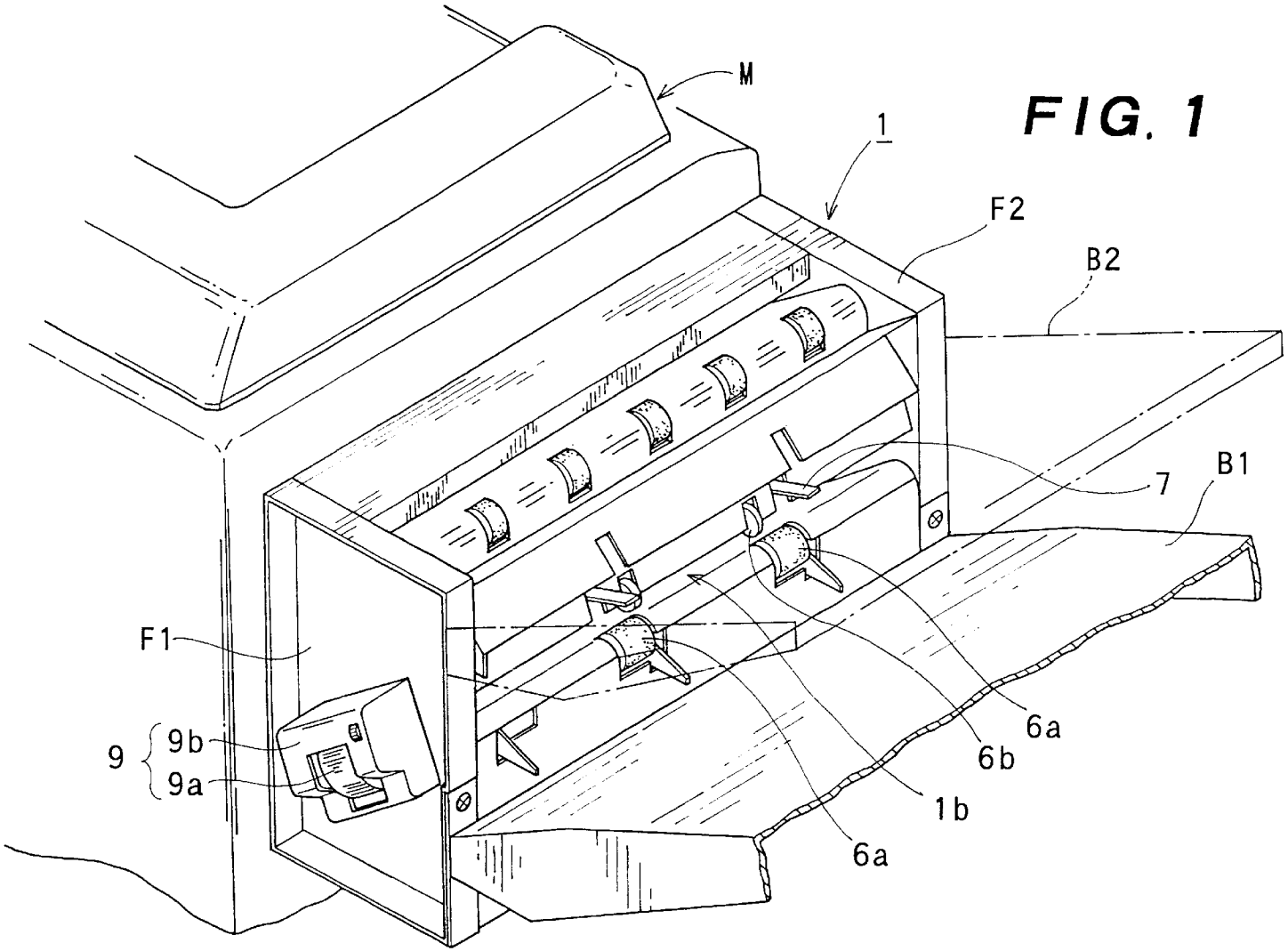
FIG. 1 is a schematic perspective view showing one embodiment of a sheet post-handling device according to this invention.

FIG. 1 is a perspective view showing the rear of the sheet post-handling device 1 of this invention as viewed from the sheet discharging side of the device coupled to the image forming apparatus (hereinafter, referred to as "copying machine M").

Figure 2:
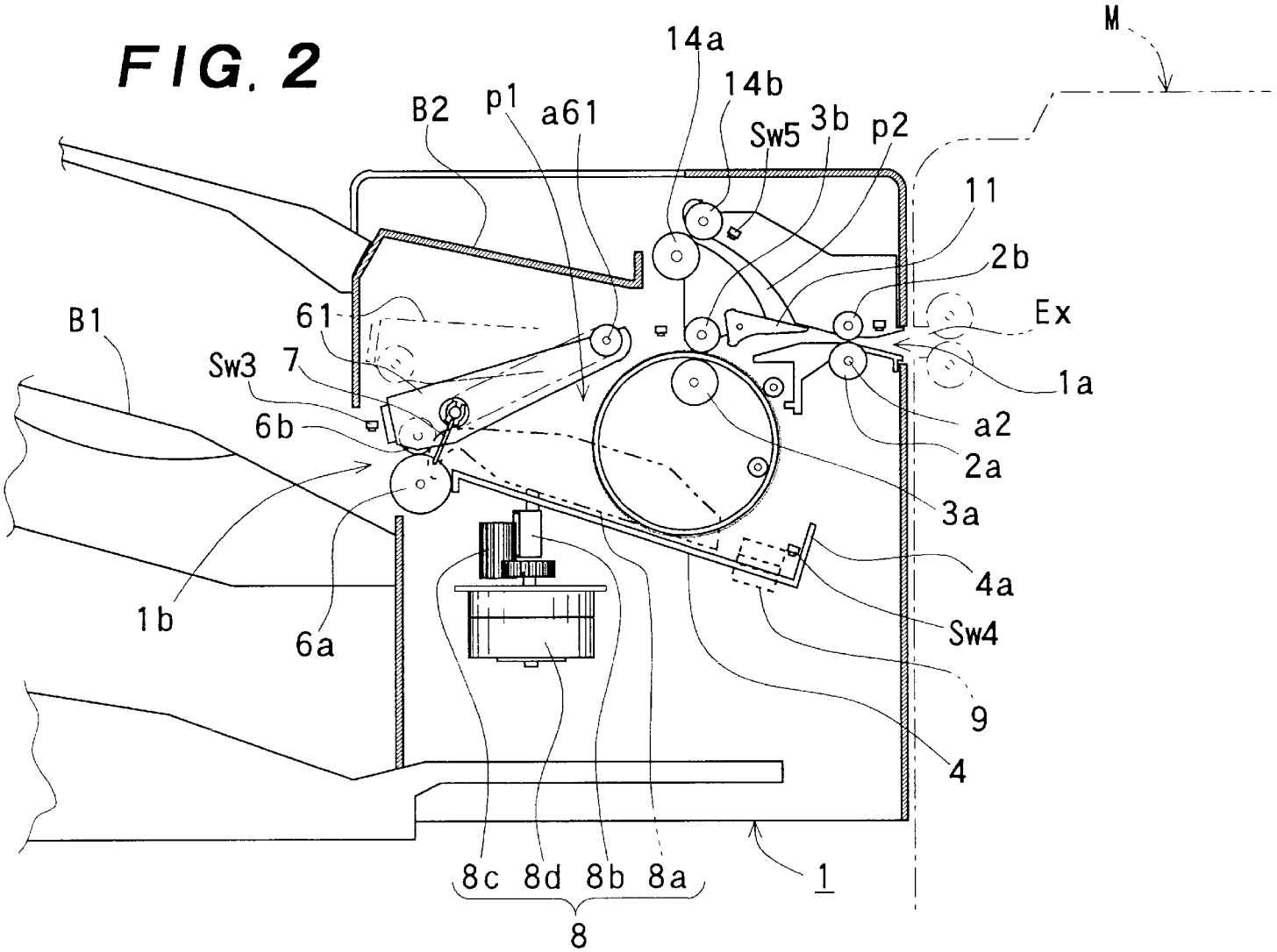
FIG. 2 is a front sectional view schematically showing a sheet transferring system in the device of FIG. 1.

As seen from FIG. 2, the device 1 is united with the copying machine M, having the sheet reception port 1*a* confronting the sheet discharge port Ex of the copying machine M. It is desirable to attach the device 1 to the copying machine M in a detachably state.

The sheet post-handling device 1 has functions of effecting a "through-pass mode" for permitting the sheet fed from the copying machine M to pass therethrough to the sheet discharge port 1*b* without subjecting the sheet to any processing, and a "stapling mode" for automatically aligning and stapling a prescribed number of sheets. Of course, the device may have functions of arranging the pages of the sheets in order, sorting the sheets and performing any other sheet processing.

Figure 3A:
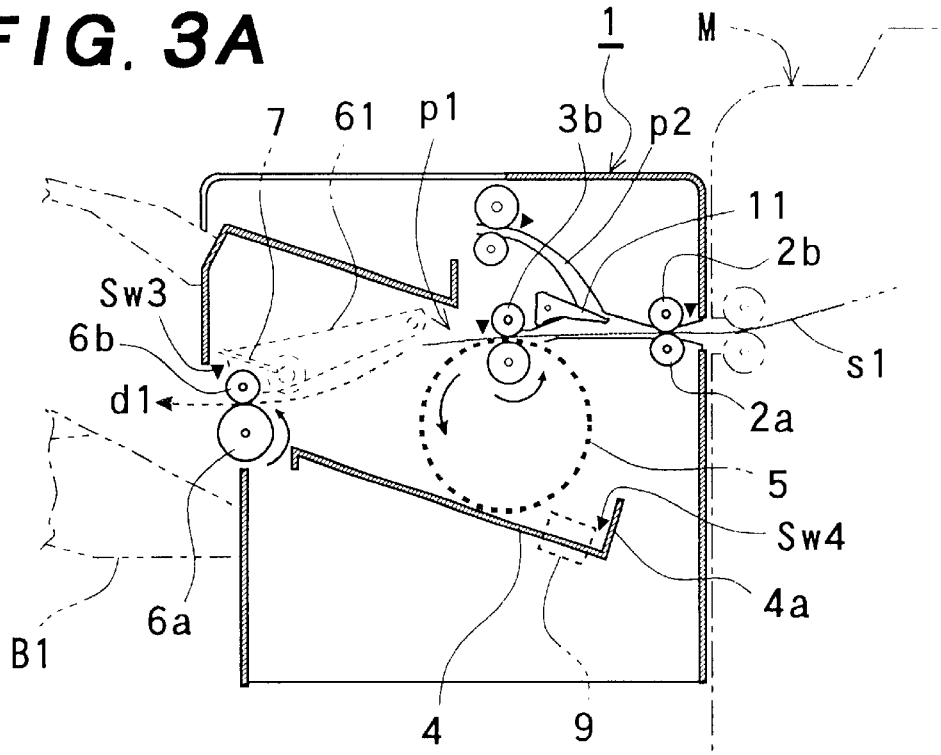
FIG. 3A is a schematic view illustrative of a sheet feeding mode and a through-pass mode of the device of this invention.
Figure 3B:
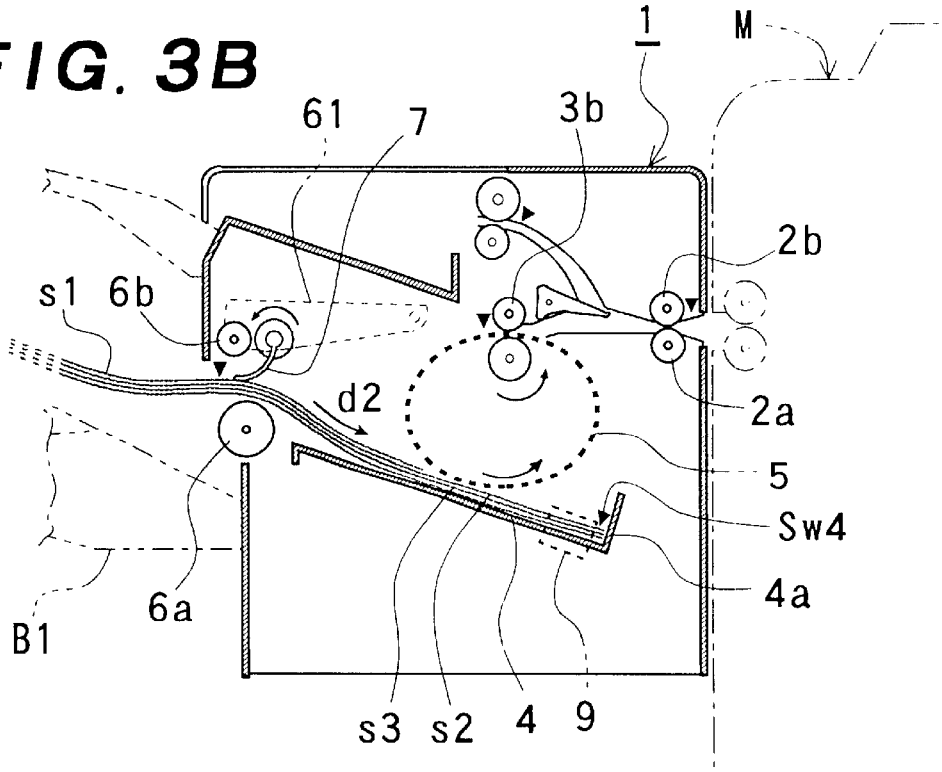
FIG. 3B is a schematic view illustrative of a sheet stapling mode of the device of this invention.

As shown in FIG. 2, FIG. 3A and FIG. 3B, the sheet post-handling device 1 includes sheet introducing rollers 2*a* and 2*b* located at the sheet reception port 1*a,* paired sheet feeding rollers 3*a* and 3*b* arranged on a sheet transfer passage p1 extending from the sheet reception port 1*a* (shown in FIG. 2) to the sheet discharge port 1*b,* a sheet processing tray 4 placed beneath the sheet trasfer passage p1, an elastically deformable feeding ring 5 of a large diameter, which has its lower portion coming in elastic contact with the upper surface of the sheet processing tray 4 and has its inner surface being in contact with the feeding roller 3*a,* paired sheet discharge rollers 6*a* and 6*b* located at the sheet discharge port 1*b,* and a paddle 7 located near the sheet discharge port 1*b.*

The aforementioned components, which constitute the sheet transferring system, are arranged between side frames F1 and F2 (shown in FIG. 4) placed on both lateral sides opposed in the direction of the width of the sheet fed from the copying machine M. For the convenience of description, the side frame F1 placed on the rear side of the copying machine M will be described as the first side frame, and the side frame F2 on the front side of the same will be described as the second side frame.

The inside distance between the first side frame F1 and second side frame F2, i.e. the width of the sheet processing tray 4, is larger than the width of the sheet of maximum size which can be dealt with by the copying machine M. However, the longitudinal length of the device in the forward direction in which the sheet is sent from the copying machine toward the sheet discharge port, i.e. the distance between the sheet introducing port 1*a* and the sheet discharge port 1*b,* may be made short no matter what the size of the sheet is. This is because the sheets can be subjected to the desired post processing in the state that only the tail end portion of the stacked sheets to be stapled is left inside the device. As a result, the sheet post-handling device 1 of the invention can be made compact.

Of the paired sheet introducing rollers, feeding rollers and discharge rollers, the rollers 2*a,* 3*a* and 6*a* are driving rollers, and the other counterpart rollers 2*b,* 3*b* and 6*b* are driven rollers in the illustrated embodiment.

The driven discharge roller 6*b* is rotatably supported at the free end of a rocking arm 61 rotatable upon a shaft a61, so that the roller 6*b* can be selectively brought into contact with the driving discharge roller 6*a* to rotate with the rocking movement of the rocking arm 61. Specially, when the sheet is required to be discharged to the external tray B1, the discharge rollers 6*a* and 6*b* come in contact with each other to send out the sheet.

The sheet processing tray 4 slopes upward in the forward direction (leftward direction in FIG. 2). The discharge rollers 6*a* and 6*b* come in contact with each other on the substantial extension surface of the sheet processing tray 4. The sheet processing tray 4 is provided with a sheet stopper 4*a* raised perpendiculaiy at its lowermost portion (end portion on the sheet reception side). Thus, when the sheets are fed onto the sheet processing tray 4 in the direction (rightward direction in FIG. 2) reverse to the forward direction, the sheets slip down along the sloping sheet processing tray 4 and collide with the sheet stopper 4*a,* consequently to be aligned in the lengthwise direction of the sheet.

The feeding ring 5 has its inner circumferential surface coming in contact with the feeding roller 3*a* and its outer circumferential surface coming in contact with the feeding roller 3*b.* That is, one arc part of the feeding ring 5 is held between the feeding rollers 3*a* and 3*b,* so as to rotate in cooperation with the feeding rollers 3*a* and 3*b* in rotation.

In the illustrated embodiment, the feeding ring 5 has the upper part coming in contact with the feeding rollers 3*a* and 3*b* and the lower part coming in contact with the sheet processing tray 4 with a relatively small pressure.

Thus, the sheet s1 fed through the sheet introducing port 1*a* in the normal transferring mode or "through-pass mode" is sent along the sheet transfer passage p1 by the rotating action of the feeding ring 5 and feeding rollers 3*a* and 3*b* in the forward direction (arrow d1) as shown in FIG. 3A.

The sheet fed in the "stapling mode" is turned back in the reverse direction (arrow d2 in FIG. 3B) with the rotation of the paddle 7, which will be described later in detail, and comes in contact with the lower part of the feeding ring 5 to be led onto the sheet processing tray 4 with a moderate frictional force brought about by the rotating feeding ring 5 until the tail end of the sheet collides against the sheet stopper 4*a*. As a result, the tail ends of the sheets can be aligned by the sheet stopper 4*a*. As the thickness of the sheets fed successively onto the processing tray 4 in the aforementioned manner is increased, the rotating feeding ring 5 moderately pushes the sheets on the processing tray toward the sheet stopper 4*a* while being elastically deformed as shown in FIG. 3B.

The sheet processing tray 4 is defined between the side frames F1 and F2 placed at both widthward sides of the tray, and is provided with a sheet aligning member 8 for aligning the sheets on the tray 4 in the widthward direction. That is, the first side frame F1 serves as an aligning reference surface.

Figure 4:
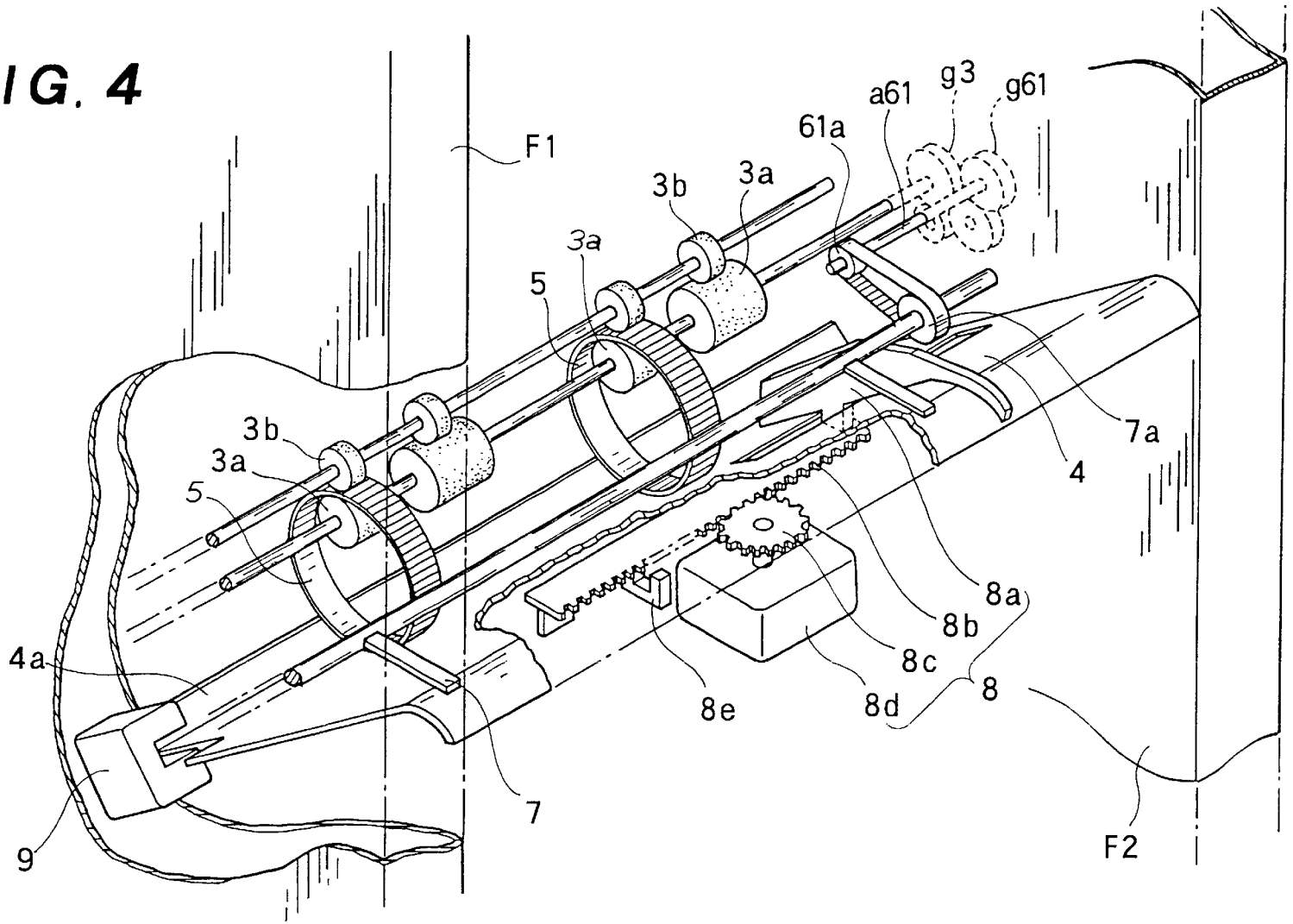
FIG. 4 is a schematic perspective view showing in part the sheet transferring system including a sheet aligning system in the device of FIG. 1.

As shown in FIG. 4, the sheet aligning member 8 includes an aligning plate 8*a* standing perpendicular to the processing tray 4, which is movable in parallel in the widthward direction, a rack 8*b* disposed beneath the processing tray 4 and connected with the aligning plate 8*a,* a pinion 8*c* engaged with the rack 8*b,* and a reversible motor 8*d* for rotating the pinion 8*c* in the forward and reverse directions. Denoted by 8*e* is a sensor for detecting the edge of the rack 8*b* movable widthward. By operating the motor 8*d* to move the rack 8*b* in the widthward direction in the state that the sheets are placed on the tray 4, the sheets are pressed against the side frame F1 (aligning reference surface) by the aligning plate 8*a* to be aligned in the widthward direction.

On the end portion of the tray 4 on the side of the side frame F1 opposite to the aligning plate 8*a,* there is disposed a stapling unit 9. The sheets which have their tail ends being in contact with the sheet stopper 4*a* and are pressed against the side frame F1 by the aligning plate 8*a* are bound by being stapled the stapling unit 9.

The stapling unit 9 in this embodiment indudes a staple cartridge 9*a* for storing staples, and a lid cover 9*b* hinged on the side frame F1. By opening or closing the lid cover 9*b,* the staple cartridge 9*a* can be mounted into and dismounted from the stapling unit 9 and held in position inside the stapling unit. The stapling unit 9 is slant in accordance with the inclination of the sheet processing tray 4 as seen from in the rear view of the device 1 in FIG. 5.

The stapling unit 9 incorporating the lid cover 9*b* and staple cartridge 9*a* has a horizontal bracket 9*c*. The bracket 9*c* is rotatably supported on a supporting pin 9*d* secured vertically on the side frame F1. With this structrre of attaching the stapling unit to the device, it becomes to shift the stapling unit 9 with the staple carridge 9*a* and lid cover 9*b* to the front side (copying machine side) of the device as illustrated by the chain line in FIG. 5, or to the rear side in the case where it is positioned on the rear side. Consequently, the staple caridge 9*a* can easily be mounted to and dismounted from the stapling unit.

In the illustrated embodiment, there is formed a second sheet transfer passage p2 branching off on the sheet transfer passage p1 extending from the sheet introducing rollers 2*a* and 2*b* to the feeding roller 3*a* and 3*b*. At the diverging point of the first and second sheet transfer passages p1 and p2, a switching flapper 11 is disposed. Reference numerals 14*a* and 14*b* denote second discharge rollers, and B2 denotes a second discharge tray. Accordingly, a sheet which need not be stapled is sent out to the second discharge tray B2 through the second sheet transfer passage p2 by switching over the switching flapper 11. This invention can provide a multi-tray type sheet handling device by forming further sheet transfer passages in the same manner, and various functions of dealing with and processing the sheets, but the mechanism including the second sheet transfer passage and the like may be omitted and should not be understood as being limited to the illustrated structure.

In the drawings, Sw1 to Sw5 denote sensors for detecting the sheet being dealt with. These sensors for detecting the front end or tail end of the sheet being transferred are used for controlling the timing of sheet transfer.

As noted above, the least the sheet s1 fed from the copying machine M is sent through the first passage in the forward direction a1 until the tail end of the sheet passes through the feeding rollers 3*a* and 3*b*. At this time, the discharge roller 6*b* supported by the rocking arm 61 rockingly rotatable is in contact with the rotating discharge roller 6*a* to rotate in conjunction with the discharge roller 6*a*.

In the "through-pass mode" for permitting the sheet s1 to pass through the device without processing the sheet, the rollers 2*a,* 2*b,* 3*a,* 3*b,* 6*a* and 6*b* continue rotating in the forward direction until the sheet passes through the discharge rollers 3*a* and 3*b,* as shown in FIG. 3A. Incidentally, the driving rollers such as the sheet introducing roller 2*a,* feeding roller 3*a,* second discharge roller 14*a* and feeding ring 5 rotate in the forward direction at all times in every mode as long as the sheet post-handling device is in operation.

In the "stapling mode", when the tail end of the sheet s1 passes through the feeding rollers 3*a* and 3*b,* the discharge roller 6*b* is separate from the discharge roller 6*a* by operating the rocking arm 61 to neutralize the sheet forwarding action brought about by the discharge rollers 6*a* and 6*b.* Simultaneously, the paddle 7 is driven in the reverse direction to send the sheet onto the sheet processing tray 4. In case where a plurality of sheets s2, s3 . . . are previously sent onto the tray 4, the sheet s1 subsequently sent onto the tray 4 is placed on top of the sheets s2, s3 . . . on the tray.

Upon completion of sending the prescribed number of sheets onto the sheet processing tray 4, the aligning member 8 is operated so that the sheets s1, s2 . . . are pressed against and aligned with the first side frame F1. Thereafter, the stapling unit 9 is operated to staple the sheets. After carrying out the desired processing in the manner as noted above, the discharge roller 6*b* is brought into contact with the driving discharge roller 6*a* across the stapled sheets to send out the stapled sheets to the external tray B1 by rotating the discharge rollers 6*a* and 6*b.*

The system for driving the sheet transferring system including the driving rollers 2*a,* 3*a* and 6*a,* rocking arm 61, feeding ring 5 and paddle 7 with the aforementioned timing will be described hereinbelow.

The driving system comprises one driving motor 21, and a transmission means for transmitting the rotation produced by the motor 21 to the respective driving rollers 2*a,* 3*a* and 6*a,* rocking arm 61, feeding ring 5 and paddle 7. Since the driving system employs only one driving motor as a power source and has the rationally assembled transmission means, it can be incorporated compact within the side frame F2.

Figure 6:
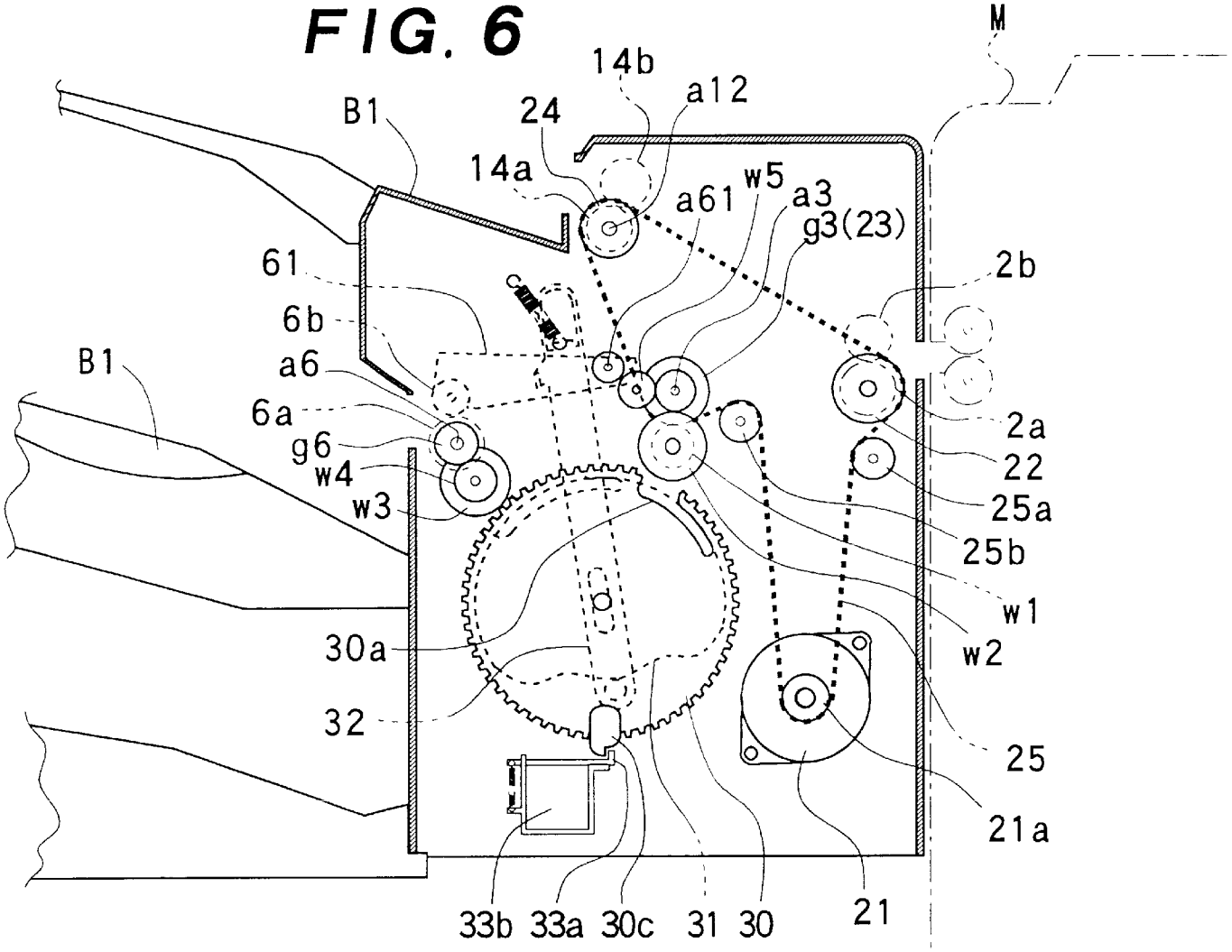
FIG. 6 is a front sectional view schematically showing a driving system in the device of FIG. 1.
Figure 7:
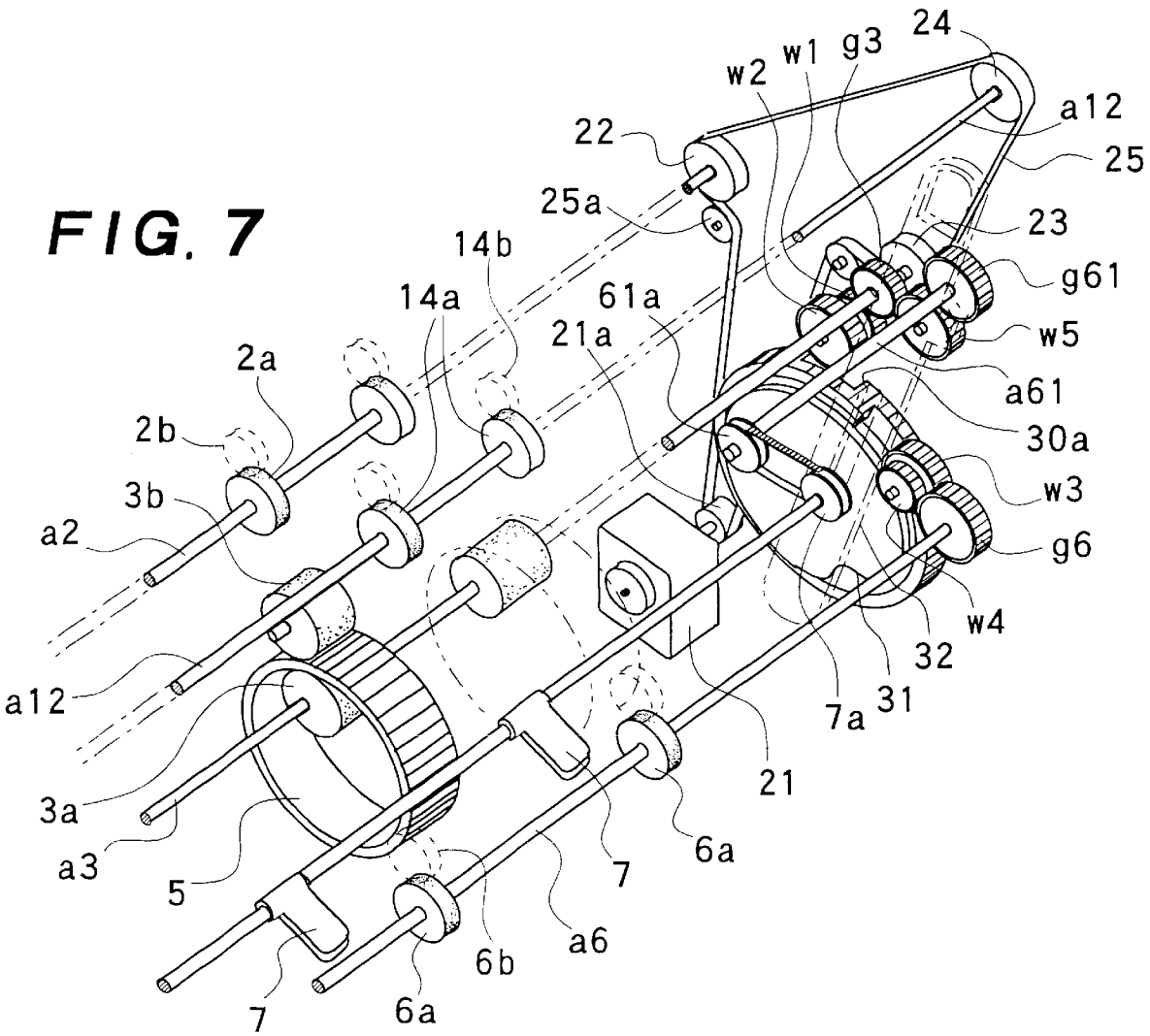
FIG. 7 is a schematic perspective view showing in part the driving system in the device of FIG. 1.

The driving system in the embodiment shown in FIG. 6 and FIG. 7 comprises a driving pulley 21*a* of the driving motor 21, a pulley 22 mounted on the rotation shaft a2 of the sheet introducing roller 2*a,* a pulley 24 mounted on the rotation shaft a14 of the second discharge roller 14*a,* a pulley 23 mounted on the rotation shaft a3 of the feeding roller 3*a,* a driving belt 25 running around the pulley 23, a gear g31 mounted on the rotation shaft a3 of the pulley 23, a large timing gear wheel 30 meshed with the gear g31 through intermediate gears w3 and w4, a partially toothed gear g61 meshed with the gear g32 mounted on the rotation shaft a3 through an intermediate gear w5, a pulley 61*a* connected to the gear g61 to selectively impart rotation to the paddle 7, a cam 31 attached to the timing gear wheel 30, and an operation lever 32 linked to the rocking arm 61 through a connection member 61*e* with a pin, which reciprocates with the rotation of the cam 31 to rockingly rotate the rocking arm 61.

At the time of operating the sheet post-handling device of the invention when feeding a sheet from the copying machine into the device, the driving motor 21 starts operating and continues rotating to drive the belt 25, consequently to rotate continuously the sheet introducing roller 2*a* connected to the pulley 22, the second discharge roller 14*a* connected to the pulley 24, and the feeding roller 3*a* connected to the pulley 23 in the forward direction.

In the drawing, by 25*a* and 25*b* are denoted tension pulleys for exerting a tension force to the belt 25.

When the sheets fed into the sheet post-handling device are stapled by the stapling means, the paddle 7 is operated to rotate in the reverse direction to send the sheets backward one by one along the processing tray 4 after each sheet passes through the feeding rollers 3*a* and 3*b.*

Figure 8A:
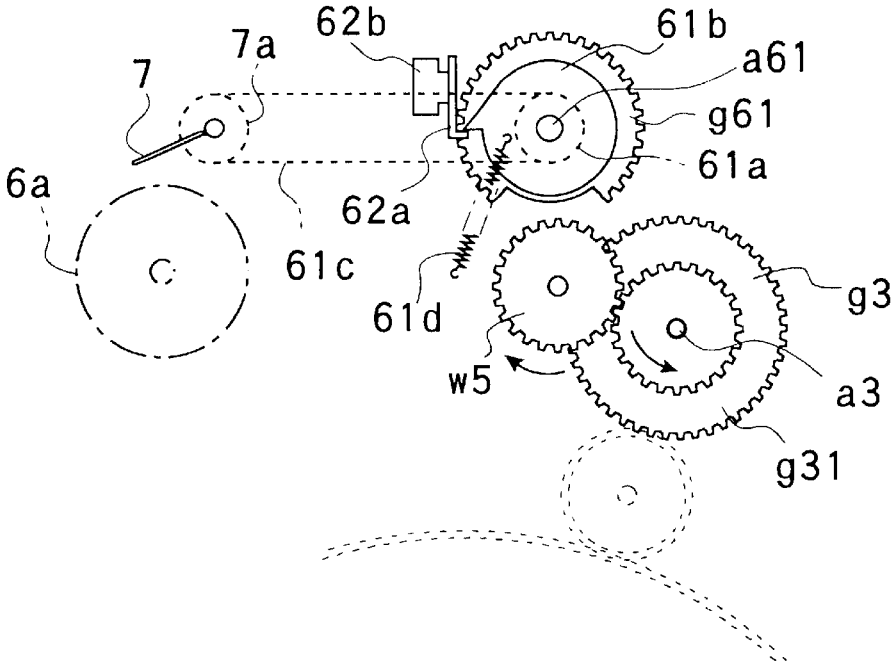
FIG. 8A and FIG. 8B are views illustrative of the operating principle of a paddle driving mechanism in the device of the invention.
Figure 8B:
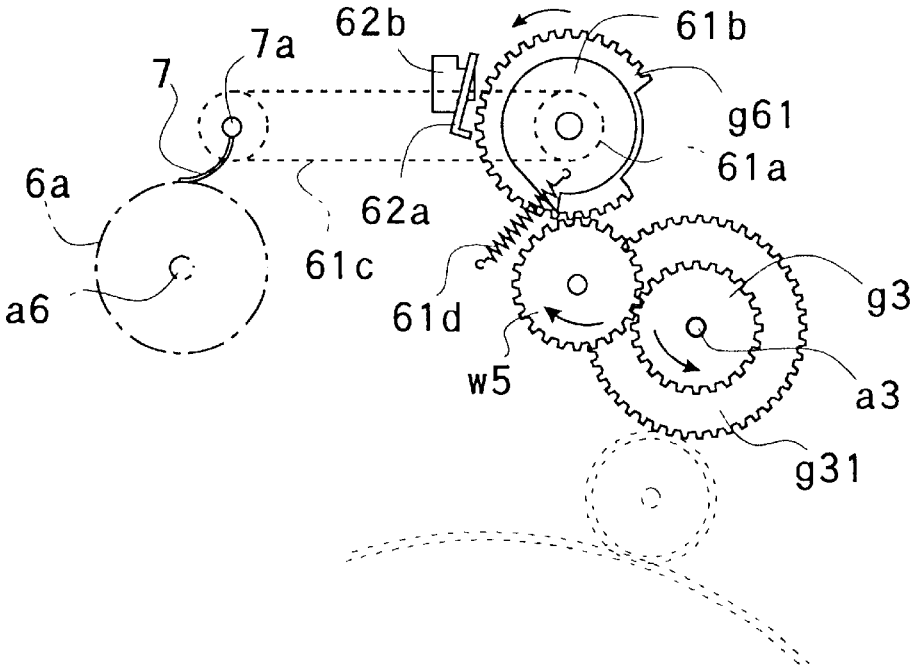

As shown in FIG. 8A and FIG. 8B, the mechanism for selectively rotating the paddle 7 in the aforenoted manner comprises a pawl wheel 61*b* united with the gear g61, an engaging member 62*a* to be engaged with the pawl wheel 61*b,* a solenoid for engaging or disengaging the engaging member 62*a* with respect to the pawl wheel 61*b,* a rotation wheel 7*a* connected to the paddle 7, and a transmission member 61*c* including a belt for connecting the rotation wheel 7*a* to the pulley 61*a.* The pawl wheel 61*b* is energized by a spring 61*d,* so that the gear g61 is engaged with the intermediate gear w5 when it can be disengaged from the engaging member 62*a.* As shown in FIG. 8A, the engaging member 62*a* is caught by the pawl wheel 61*b* to keep in position the gear w5 at the non-toothed part of the partially toothed gear g61, to prevent the rotation of the gear 25 from being transmitted to the gear g61.

To be more specific, FIG. 8A shows a normal state of transferring the sheet in the forward direction. FIG. 8B shows the state in which the sheet is moved backward along the tray 4 by rotating the paddle 7 in the reverse direction in the "stapling mode". That is to say, in the normal state of FIG. 8A, the gear w5 confronting the non-toothed part of the partially toothed gear g61 is maintained by causing the engaging member 62*a* to prevent the rotation of the pawl wheel 61*b,* consequently to bring the paddle 7 to a standstill.

When the paddle 7 is required to rotate, the engaging member 62*a* is out of place to release the engagement with the pawl wheel 61*b,* consequently to permit the partially toothed gear g61 to rotate counterclockwise in FIG. 8B by the action of the spring 61*d.* The pawl wheel 61*b* continues rotating until the gear w5 meets the non-toothed part ofthe gear g61 again. While the gear g61 rotates, the engaging member 62*a* returns, and thereafter, engages with the pawl of the pawl wheel 61*b* in rotation to retain the pawl wheel in the normal state shown in FIG. 8A.

Although the mechanism for selectively rotating the paddle is constructed as above, it may be formed merely of an electromagnetic clutch or the like instead.

On the other hand, during the rotation of the paddle 7, the discharge roller 6*b* is separate from the discharge roller 6*a* to neutralize the sheet forwarding action of the discharge rollers 6*a* and 6*b* (FIG. 8B).

The sheet introduced into the device is transferred in the forward direction by the sheet transferring system including the discharge rollers 6*a* and 6*b* when the paddle 7 stops rotating. When the sheet is moved backward by the paddle 7, the discharge roller 6*b* is separate from the discharge roller 6*a* to neutralize the forward feeding action of the discharge rollers 6*a* and 6*b.* The switchover action of the discharge rollers and paddle as noted above is carried out by operating the rocking arm 61 with the timing gear wheel 30, cam 31, and the operation lever 32 which is upwardly energized by the spring 32*a* so as to driven by the rotating cam 31.

The timing gear wheel 30 comprises a gear with a non-toothed part 30*a,* which is engaged with an intermediate gear w2, a gear with a non-toothed part 30*b,* which is engaged with an intermediate gear w3, and a claw member 30*c* which is caught by a hook member 33*a* to keep the timing gear wheel 30 in the state that the non-toothed part 30*b* confronts the intermediate gear w3 to prevent the gear w3 from rotating. The hook member 33*a* is operated to be engaged and disengaged with respect to the claw member 30*c* by means of a solenoid 33*b*. Denoted by 30*d* is a weight attached to the timing gear wheel 30.

Figures 9A, 9B, 9C:
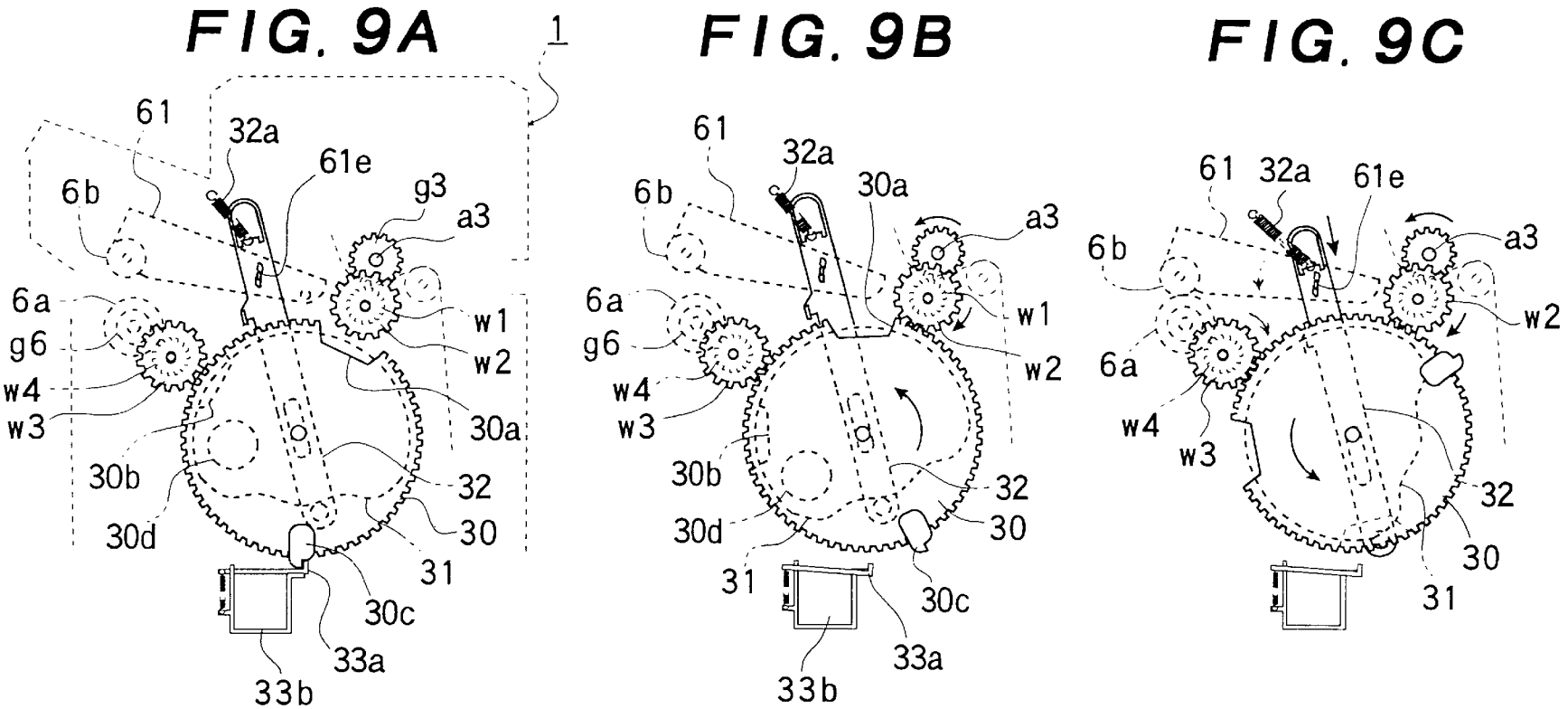
FIG. 9A and FIG. 9B are views illustrative of the operating principle of bringing sheet discharge rollers into contact and out of contact with each other in the device of the invention.

FIG. 9A shows the state in which the discharge roller 6*b* is separated from the discharge roller 6*a* by swinging the rocking arm 61 upward, consequently to permit the sheet to be moved backward. FIG. 9B shows the state in which the rocking arm 61 starts to swing downward. FIG. 9C shows the sheet forwarding state in which the discharge roller 6*b* is in contact with the discharge roller 6*a*.

In the state of FIG. 9A, the non-toothed part 30*a* of the timing gear wheel 30 confronts the intermediate gear w2 to keep the timing gear wheel 30 in the standstill state. This standstill state of the timing gear wheel corresponds to the "stapling state" shown in FIGS. 8A and 8B and is maintained by the hook member 33*a* in engagement with the claw member 30*c*. In this state, the sheet can be moved backward by allowing the rocking arm 61 to retreat upward and the paddle 7 to rotate, but the processes shown in FIG. 9A to 9C are repeated as the timing gear wheel 30 makes one rotation each time the sheet is fed from the image forming apparatus.

When the sheet passes through between the feeding rollers 3*a* and 3*b* in the state of FIG. 9A, the solenoid 33*b* is operated to release the hook member 33*a* from the claw member 30*c*, the timing gear wheel 30 rotates by the action of the weight 32. Even when the timing gear wheel 30 is slightly rotated by the action of the weight 32, the rotating intermediate gear w2 is meshed with the timing gear wheel 30 as shown in FIG. 9B, to rotate the timing gear wheel 30. Simultaneously, the intermediate gear w3 is engaged with the timing gear wheel 30.

When rotating t1he timing gear wheel 30, the operation lever 32 following the cam 31 moves downward against the spring 32*a* to swing the rocking arm 7*a*, consequently to bring the discharge roller 6*b* in contact with the discharge roller 6*a*. As a result, the sheet is sent out in the forward direction.

Although the discharge roller 6*b* is moved to and fro relative to the discharge roller 6*a* by means of a mechanism including the operation lever 32, it may be operated by using electric driving means such as an electromagnetic actuator and electromagnetic clutch.

As noted above, the present invention enables the transferring and driving systems for transferring the sheet introduced into the device 1 in the forward direction and stapling the sheet fed successively onto the tray 4 in the reverse direction to be driven effectively by only one driving motor, so that the transferring and driving systems can be assembled compact within the side frame F2. Thus, the sheet post-handling device can be made compact.

Figure 10:
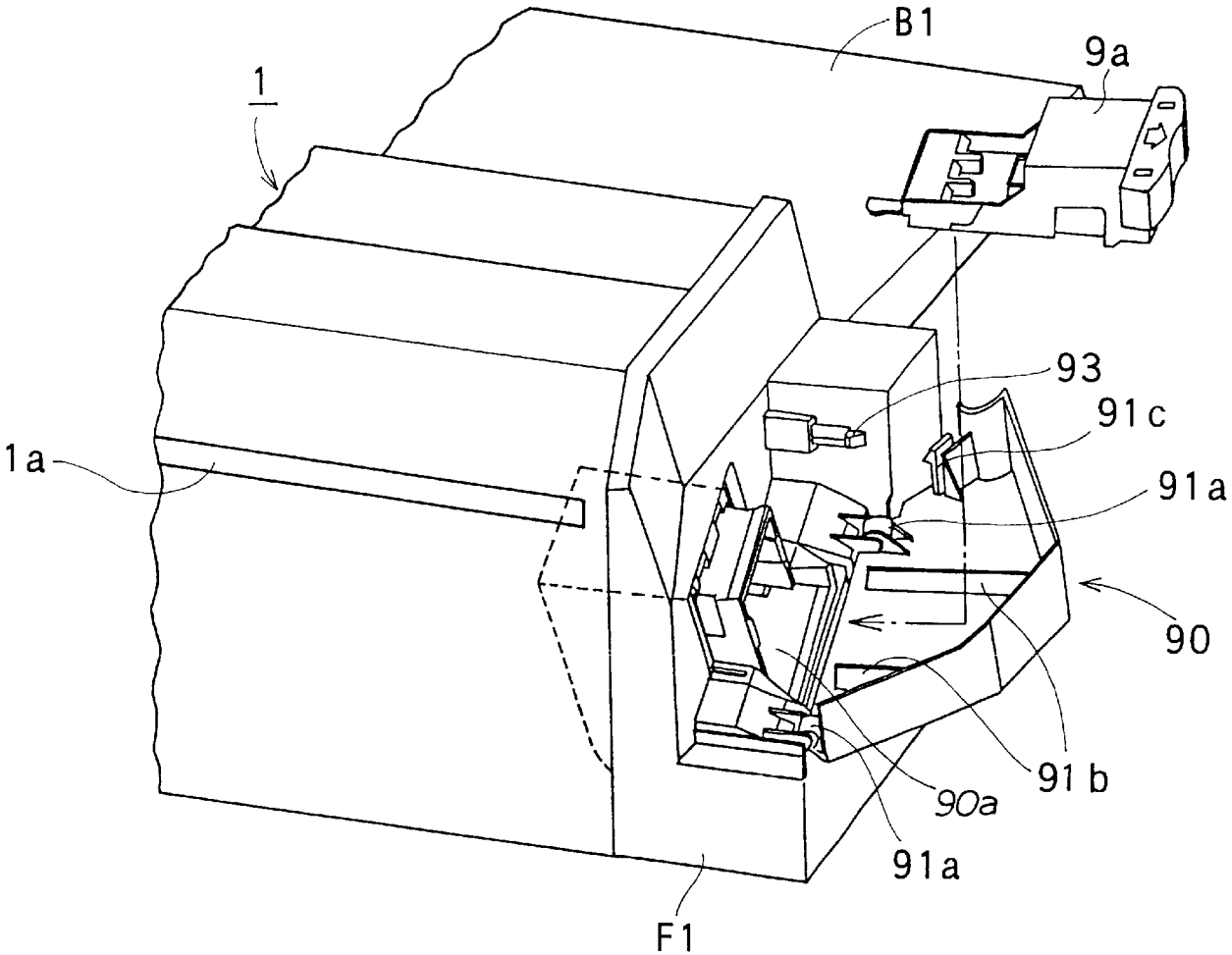
FIG. 10 is a perspective view showing a structure for mounting the stapling unit onto another embodiment of this invention.

The stapling unit 9 mounted to the side frame F1 on the rear side of the device 1 has a structure for placing the staple cartridge 9*a* therein upon opening of the lid cover 9*b* as described earlier. As shown in FIG. 10, the lid cover 91 may be openable downward so as to use the inside ribs thereof as a guide for assuredly introducing the staple cartridge into tihe stapling unit with ease.

That is, the lid cover 91 is openably attached to a cartridge insertion opening 90*a* formed in the stapling unit 90 by a hinge 91*a* placed on the lower side of the cartridge insertion opening. Inside the lid cover, the guide ribs 91*b* separated by the width of the staple cartridge 92 are formed, so that the staple cartridge can easily be introduced into the inside of the stapling unit 90 along the guide ribs 91*b* on the lid cover 91 opening horizontally.

The lid cover 91 is firmly held in its closed state by causing a hook member 93 to catch a claw 91*c* formed on the lid cover 91.

Figure 11:
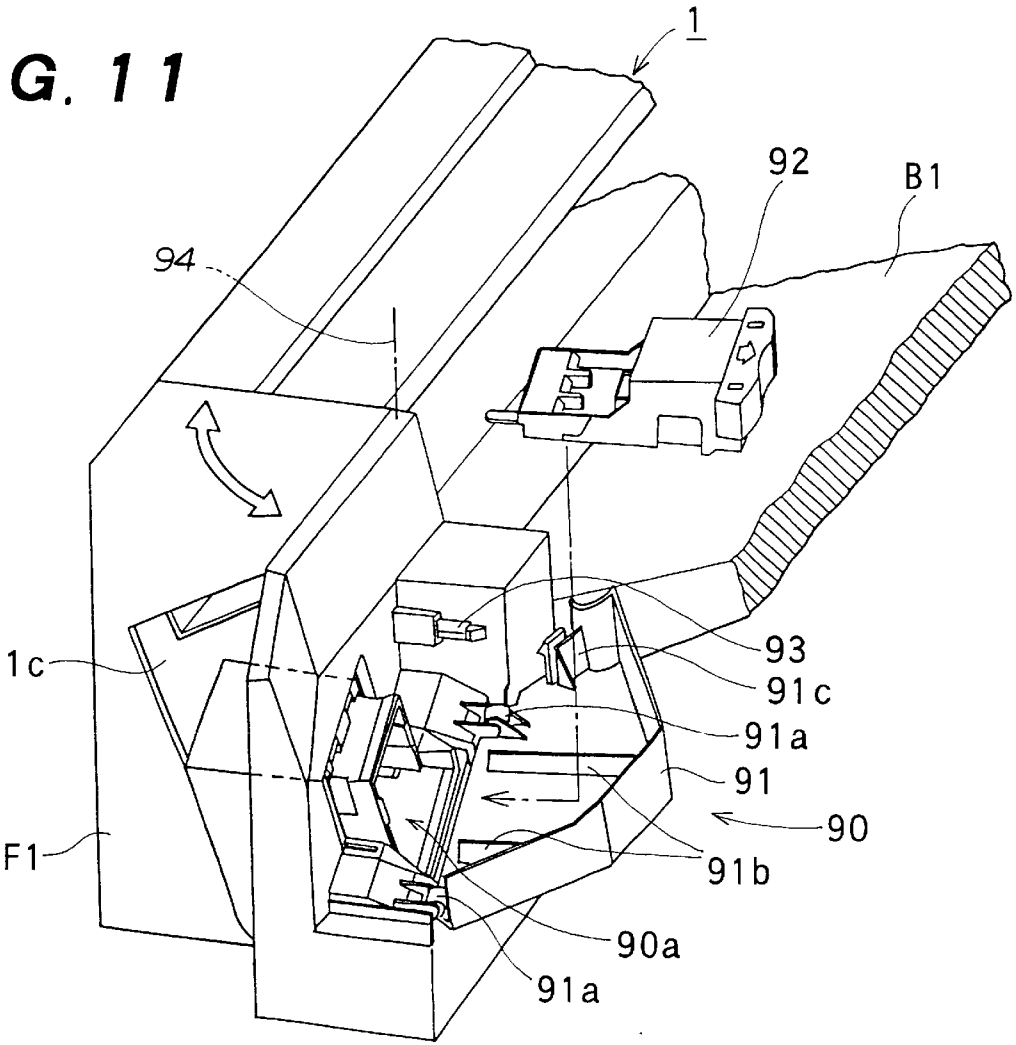
FIG. 11 is a perspective view showing a structure for mounting the stapling unit onto still another embodiment of this invention.

FIG. 11 shows an embodiment in which the stapling unit 90 and lid cover 91 shown in FIG. 10 are supported by a unit holder 95 rotatably hinged on the side frame F1 by a hinge pin 94. In this illustrated embodiment, the elements depicted by the same reference numerals with respect to those of FIG. 10 have analogous structures and functions to those of FIG. 10 and will not be described in detail again.

The unit holder 95 in FIG. 11 is swung about the hinge pin 94 to assume its open state. When the unit holder 95 is swung about the hinge pin 94 to close, the stapling unit 90 is fitted into an opening 1*c* formed in the side frame F1 and held in position in the sheet post-handling device 1.

Figure 5:
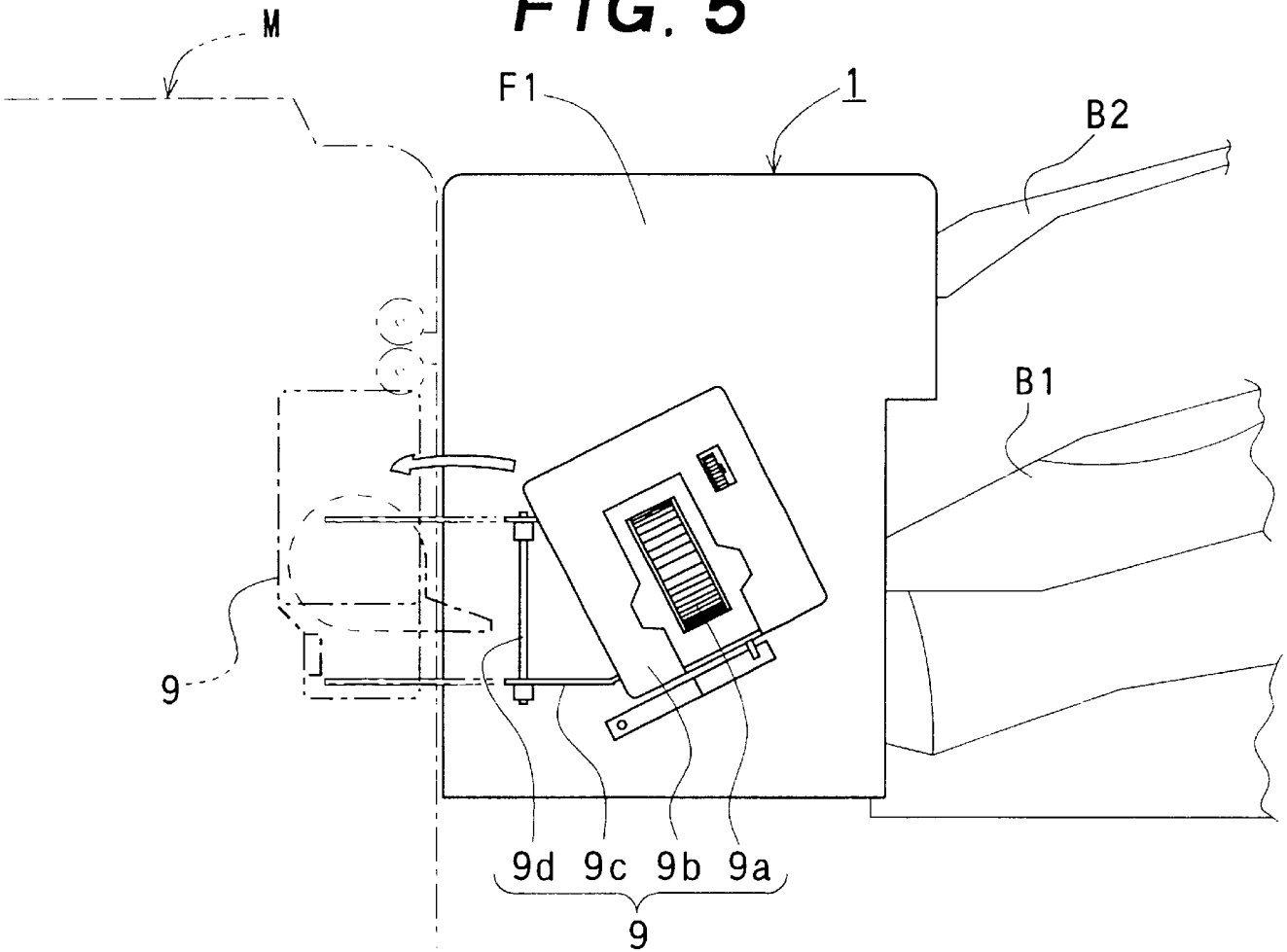
FIG. 5 is a rear view schematically showing the state in that a stapling unit is openably mounted on the device of FIG. 1.

Since this embodiment makes it possible to move the unit holder 95 from the back side of the device 1 to one side thereof, similarly to the stapling unit 9 shown in FIG. 5, the staple cartridge 92 can easily be inserted into and removed from the stapling unit.

Figure 12:
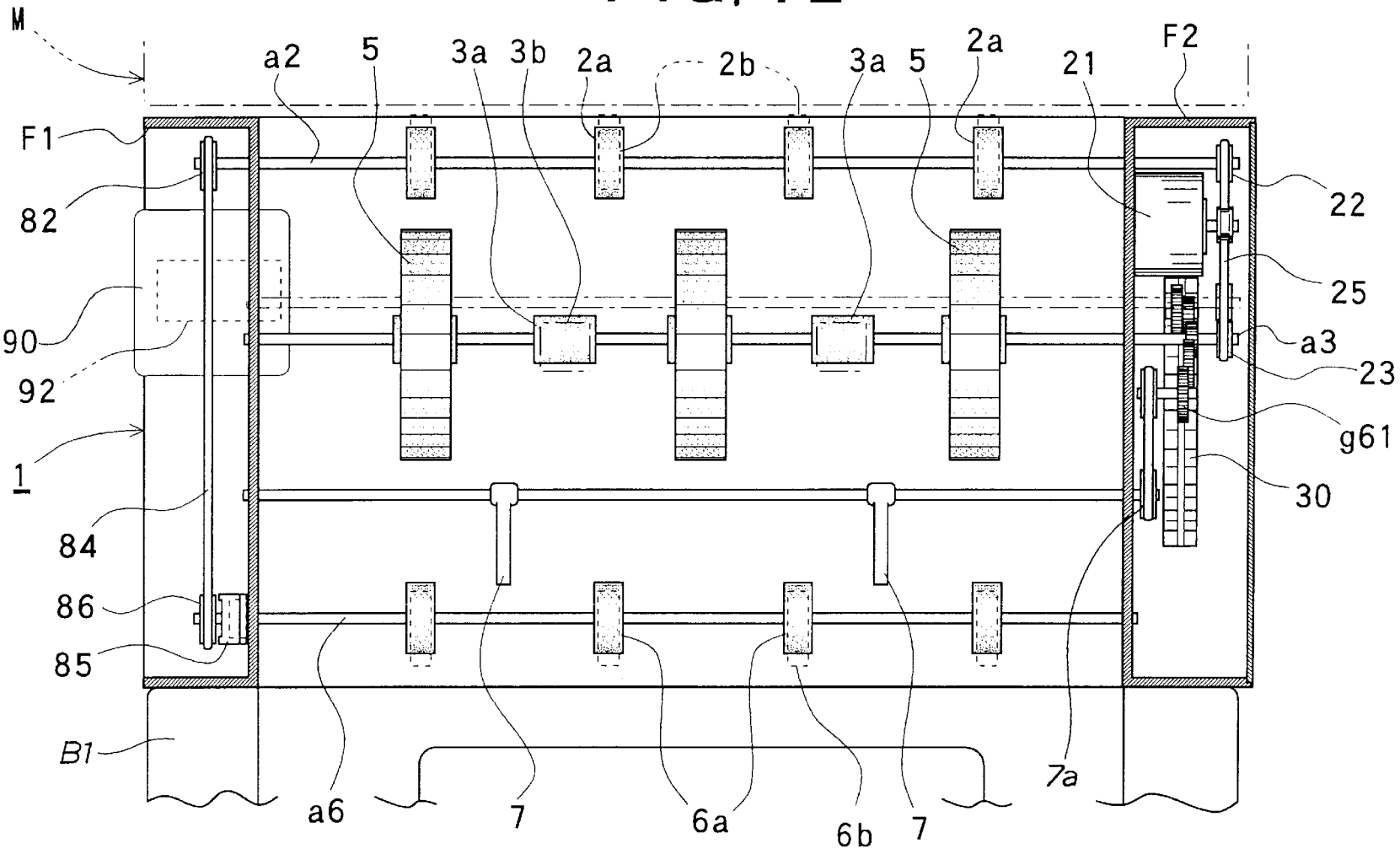
FIG. 12 is a plan view schematically showing yet another embodiment of this invention.

Also, it is optional to drive the sheet discharge roller 6*a* by making use of the rotation of the rotation shaft a2 of the sheet introducing roller 2*a*. In this case, a transmission means for transmitting the rotation of the sheet introducing roller 2*a* to the sheet discharge roller 6*a* maybe assembled within the first side frame F1. That is, as shown in FIG. 12, the transmission means may be formed of pulleys 82 and 86 disposed at the respective ends of the rotation shafts a2 and a6 of the sheet introducing roller 2*a* and the discharge roller 6*a* on the side of the first side frame F1, and a transmission belt 84 for connecting the pulleys with each other. The discharge roller 6*a* should be stopped provisionally in the case of sending the sheet backward along the processing tray though the sheet introducing roller 2*a* always rotates in the forward direction when the device is in operation. It is desirable to use an electromagnetic clutch 85 for selectively stopping the discharge roller 6*a* disposed on the rotation shaft a6 as illustrated.

According to this embodiment, the intermediate gears w3 and w4 and the gear g61 placed between the timing gear wheel 30 and the discharge roller 6*a* in the preceding embodiment can be omitted, and besides, some of the components incorporated within the second side frame F2 in the preceding embodiment can be shifted into the first side frame Fl. Consequently, the degree of freedom in designing the device of the invention can be heightened.

Although, in the accompanying drawings including FIG. 12, the sheet introducing rollers, feeding rollers, feeding ring and discharge rollers are illustrated by way of one example of the invention, the number, mounting location and shape of these components may be changed and are not specifically limited in the invention.

As is apparent from the foregoing description, the sheet post-handling device according to this invention can perform the required processing such as stapling of sheets in a state of supporting only the tail end portion of the stacked sheets within the device regardless of the size of the sheets sent out from the image forming apparatus. Furthermore, the sheet post-handling device of the invention can be made small and light in weight, since the stapling unit, sheet transferring system and driving system required for effecting the sheet post-processing can be rationally incorporated within the side frames. Specifically, the driving system is operated and controlled with exquisite timing by using only one motor and simple rotation transmission means. As a result, the sheet post-handling device can be compact, and the sheet transferring and post-processing can be assuredly carried out. Moreover, according to the present invention, the staple cartridge can easily be fitted into the stapling unit, and the stapling unit can be moved from the back side to the lateral side of the sheet post-handling device, so that the staple cartridge can be inserted into and taken off from the stapling cartridge more easily. Thus, this invention brings about marked effects in that the sheet post-handling device can be made compact and easily and conveniently operated and dealt with.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A sheet post-handling device comprising a sheet transfer passage extending from a sheet reception part to a sheet discharge part, first and second side frames on both sides of said sheet transfer passage, a sheet processing tray defined between said side frames for supporting a part of sheets to be processed, a stapling unit mounted in said first side frame for stapling the sheets at one side portion of said sheet processig tray, a sheet transferring system for transferring the sheet along said sheet transfer passage, and a driving system for driving the sheet transferring system, sad driving system being mounted in said second side frame.

2. The sheet post-handling device as claimed in claim 1, further comprising a sheet aligning member for aligning the sheets on said sheet processing tray by pressing the sheets against said first side frame.

3. The sheet post-handling device as claimed in claim 1, wherein said sheet transferring system includes sheet introducing rollers disposed at said sheet reception part, feeding rollers disposed on said sheet transfer passage, a large diameter feeding ring having its upper portion coming in contact with said feeding rollers so as to rotate in conjunction with said feeding rollers and its lower portion coming in elastic contact with said sheet processing tray, and sheet discharge rollers disposed at said sheet disharge part, and wherein said driving system includes one motor for rotating at least one of said sheet introducing rollers and at least one of said discharge rollers, a timing gear wheel selectively driven by said feeding rollers, and a paddle disposed at the sheet discharge part to be selectively driven to rotate.

4. The sheet post-handling device as claimed in claim 3, wherein said timing gear wheel selectively imparts rotation to one of said sheet discharge rollers through at least one gear.

5. The sheet post-handling device as claimed in claim 3, wherein at least one of said sheet introducing rollers selectively imparts rotation to at least one of said sheet discharge rollers through a transmission means incorporated within said first side frame.

6. The sheet post-handling device as claimed in claim 3, wherein one of said sheet discharge rollers is supported by a rocking arm so as to be selectively brought into contact with the other sheet discharge rollers.

7. The sheet post-handling device as claimed in claim 1, wherein said stapling unit includes a staple cartridge detachably fitted into said stapling unit, and a lid cover hinged openably on said first side frame.

8. The sheet post-handing device as claimed in claim 7, wherein said lid cover is provided with a guide for introducing said staple cartridge into said stapling unit.

9. The sheet post-handling device as claimed in claim 7, wherein said stapling unit is held by a bracket rotatably supported on said first side frame.

10. A sheet post-handling device comprising:

a sheet transfer passage extending from a sheet reception part to a sheet discharge part, first and second side frames formed on both sides of said sheet transfer passage, a sheet processing tray defined between said side frames for supporting a tail end part of sheets to be processed, a stapling unit mounted in said first side frame for stapling the sheets at one side portion of said sheet processing tray, a sheet transferring system including sheet introducing rollers disposed at said sheet reception part, feeding rollers disposed on said sheet transfer passage, a large diameter feeding ring rotatable in conjunction with said feeding rollers, and sheet dissharge rollers disposed at said sheet discharge part, and a driving system incorporated within said second frame, said driving system including one motor for rotating said sheet introducing rollers and said feeding rollers in a forward direction, a timing gear wheel selectively driven by said feeding rollers, a paddle disposed at the sheet discharge part to be selectively driven to rotate, and a transmission means for selectively transmitting rotation of said timing gear wheel to said discharge rollers.

* * * * *